United States Patent [19]

Tanksley

[11] 4,003,206

[45] Jan. 18, 1977

[54] UNIVERSAL END CONNECTOR FOR FLOATING BOOM

[75] Inventor: Neeld D. Tanksley, Antioch, Calif.

[73] Assignee: Pacific Pollution Control, Inc., Emeryville, Calif.

[22] Filed: Aug. 20, 1975

[21] Appl. No.: 605,978

[52] U.S. Cl. ..... 61/1 F; 210/DIG. 25

[51] Int. Cl.[2] ..... E02B 15/04

[58] Field of Search ..... 61/1 F, 1 R, 62, 61, 61/5; 210/242 S, DIG. 25; 114/.5 F

[56] References Cited

UNITED STATES PATENTS

| | | | |
|---|---|---|---|
| 1,806,967 | 5/1931 | Dougherty et al. | 61/62 |
| 3,306,585 | 2/1967 | Blum | 256/65 |
| 3,353,610 | 11/1967 | Vidal | 61/1 F X |
| 3,686,870 | 8/1972 | Blomberg | 61/1 F |
| 3,744,253 | 7/1973 | Williams et al. | 61/1 F |
| 3,766,738 | 10/1973 | Gauch | 61/1 F |

FOREIGN PATENTS OR APPLICATIONS

| | | | |
|---|---|---|---|
| 1,305,469 | 8/1962 | France | 61/1 F |
| 494,989 | 6/1954 | Italy | 61/1 F |

*Primary Examiner*—Dennis L. Taylor
*Attorney, Agent, or Firm*—Warren, Chickering & Grunewald

[57] ABSTRACT

A universal end connector for releasably coupling together aligned ends of a floating boom or the like is disclosed. The end connector is formed with a normally vertically extending body having a first side adapted for mounting to the end of the boom and a second coupling side formed as a yoke-like bifurcated side having a pair of spaced apart neck portions terminating in enlarged head portions. The neck and head portions define a throat and enlarged cavity therebetween dimensioned for receipt of the head and neck of a similarly formed second end connector. The throat and cavity of the end connectors are open at least one of a top and a bottom end thereof to permit selective positioning of the end connectors in coupled and uncoupled relation. The enlarged head of the end connector is preferably formed with inwardly facing and inclined surfaces on either side of the head so as to cause the head portions to be pulled together and narrow the throat to enhance coupling under normal loading of the connector.

12 Claims, 7 Drawing Figures

UNIVERSAL END CONNECTOR FOR FLOATING BOOM

BACKGROUND OF THE INVENTION

One of the most effective tools in the control of oil spills on bodies of water is the floating boom or barrier. The boom is preferably formed for rapid deployment or may be permanently installed in an area in which the likelihood of oil spills is significant. Most floating booms, whether deployable or permanently installed, are formed from sections of barrier material. It is not uncommon for such a floating boom to have a length of 2,000 to 3,000 feet, and such extreme length usually necessitates the formation of the boom in sections, e.g., 100-foot lengths.

Numerous systems have been devised to releasably connect the ends of sections of floating boom. While such boom end connectors have been effective to varying degrees, they have also been found to have numerous shortcomings. In some instances, the ends of the boom sections are merely bolted together, as is shown, for example, in U.S. Pat. No. 3,792,589. This approach produces a sturdy connection, but is undesirably time-consuming in coupling and uncoupling the boom sections. In U.S. Pat. Nos. 3,720,062 and 3,818,708, the end connectors take the form of intermeshing loops which can be positioned to cause alignment of an axially extending hole through which a hinge pin or rod is mounted. In addition to the problem of aligning the hole, coupling such booms requires a separate hinge pin or rod, which can become lost or misplaced. More complex approaches are shown in U.S. Pat. No. 3,757,526 and U.S. Pat. No. 3,756,031, the latter of which employs interfitting hook-like elements and an interlocking pin. U.S. Pat. Nos. 3,353,610 and 3,624,701 disclose connectors employing interfitting end pieces, but these systems have the disadvantage of either requiring a separate connector element or having male and female connectors which require reversing of the ends of the boom segment in some instances.

U.S. Pat. Nos. 3,686,870 and 3,710,577 disclose booms having other forms of boom end connectors similar to the various types above-described. In addition, at least one end connector has been developed which is an extrusion having a C-shaped cross-section. This extrusion is mounted to one boom segment and a second extrusion may be longitudinally inserted into the center of the first extrusion and extends outwardly through the slot-like opening defined by the legs of the C so as to be connected to a second boom segment. While this type of boom end connector has some highly desirable characteristics, it still is basically a male-female connector which can require reversal of one of the boom segments if the connector ends are not of differing gender.

It is an object of the present invention to provide an end connector for a floating boom, barrier or the like which can be rapidly coupled to and uncoupled from a similarly formed end connector to provide an extremely high strength coupling of boom segments.

It is another object of the present invention to provide an end connector for a floating boom or the like which is universal and does not have a male or female coupling end.

It is still a further object of the present invention to provide an end connector for a floating boom or the like in which loading of the connector enhances the coupling force.

Still a further object of the present invention is to provide an end connector for a floating boom or the like which can be employed to couple a boom to stationary objects and yet accommodate radical changes in the water level such as occur by reason of tides or the like.

Still a further object of the present invention is to provide an end connector which can be incorporated into a wide variety of temporary and permanent oil pollution control barriers.

Still another object of the present invention is to provide an end connector for a floating boom or the like which is easy to manufacture, durable, has a minimum of parts and can be used by relatively unskilled personnel.

The end connector for floating booms or the like of the present invention has other objects and features of advantage which will become apparent from or are set forth in detail in the following detailed description of the preferred embodiment and the accompanying drawing.

SUMMARY OF THE INVENTION

The end connector of the present invention is formed for releasably coupling aligned ends of a floating boom and includes a normally vertically extending connector body formed with a first side adapted for mounting to the end of a floating boom and a second side formed for releasably coupling to another end connector. The improved end connector of the present invention is comprised, briefly, of the second side being formed as a yoke-like bifurcated side having a pair of spaced apart neck portions each terminating in enlarged head portions, the neck and head portions defining therebetween a throat and an enlarged cavity dimensioned for receipt of the head portion of a similarly formed connector. The throat and cavity are open at at least one of the top and bottom ends thereof to permit positioning of the head of a second connector in the enlarged cavity and thereby couple the end connectors together. The head portion of the universal end connector of the present invention further is preferably formed with inwardly facing surfaces which extend from the neck portion and are inclined inwardly to cause the head portions of the connector to be pulled together to narrow the throat portion defined by the heads and enhance coupling during loading. The end connector can also be used as part of a permanent installation having a longitudinal length of almost any desired dimension to accommodate vertical reciprocation of a similarly formed end connector therein under tide and wave action.

DESCRIPTION OF THE PREFERRED EMBODIMENT

Figure 1:
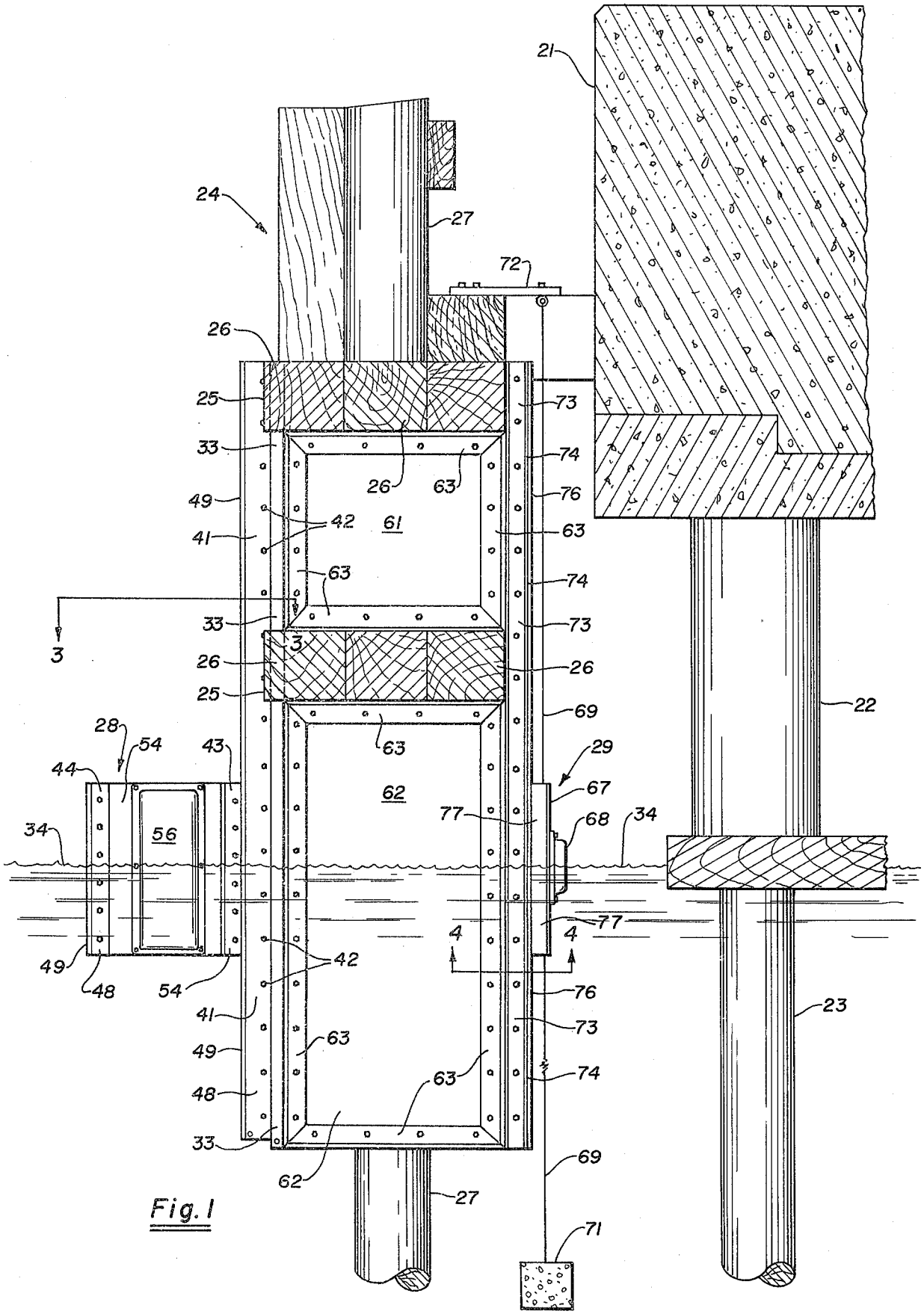
FIG. 1 is a side elevational view of a typical pier and fender installation showing a section of floating boom coupled thereto by an end connector constructed in accordance with the present invention.
Figure 2:
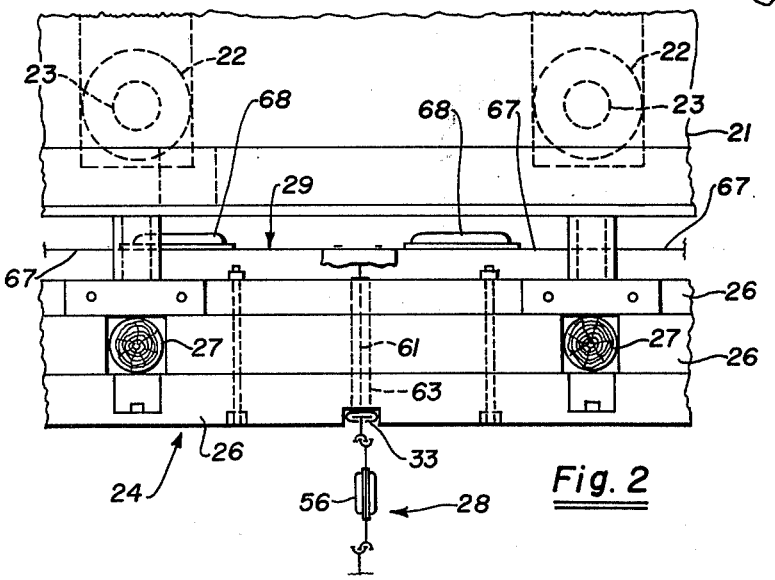
FIG. 2 is a top plan view, reduced in size, of the installation of FIG. 1.

While it will be immediately understood that the end connector of the present invention has many applications, it has been shown, particularly in FIGS. 1 and 2, as incorporated into a floating boom oil containment system removably attached to a pier. The main body or section 21 of the pier is supported on pilings 22 and 23 in a conventional fashion. Outwardly of the main body 21 of the pier is positioned a protective fender, generally designated 24. Fender 24 is designed to cushion the impact of vessels so that the large mass of the vessel is not urged against the more rigid main body 21 of the pier during docking and undocking. Fender structure 24 includes longitudinally extending beams or elements 26 which are supported by pilings 27, with the outermost beams 26 providing a surface 25 against which the vessel may be moored.

While precautionary steps are actively employed, there exists a significant chance of an inadvertent oil spill during mooring of the vessel at a pier. While the vessel is so moored, it is very often also in the process of being refueled. If the vessel is a tanker, it may be in the process of off-loading a liquid cargo which would pollute the body of water on which the vessel floats. Accordingly, accidental oil spills proximate a pier, while infrequent, are a serious problem. The problem is complicated further by the fact that the water normally extends under a substantial area of the pier and between the supporting pilings. Thus, when an oil spill occurs, the oil often travels underneath the pier and adheres temporarily to the pilings. Even if the oil slick can be contained, the individual pilings must each be cleaned so that subsequent tides do not cause the oil adhering to the pilings to float off the same and again pollute the body of water.

As a result of the possible problems which can occur during the loading and unloading of fuels from ships, recent efforts have been made to deploy a floating boom or barrier around each ship after it has been moored at the loading and unloading pier. In addition, attempts have been made to relatively permanently install a floating barrier at the fender structure of the pier to prevent oil spills from floating underneath the pier and its multiplicity of pilings. Such a floating boom containment system and a floating barrier at the fender is shown in FIGS. 1 and 2.

The boom section which is removably coupled to the fender and extends outwardly around the vessel is generally designated 28, while the floating barrier relatively permanently installed at the fender is generally designated 29.

Figure 3:
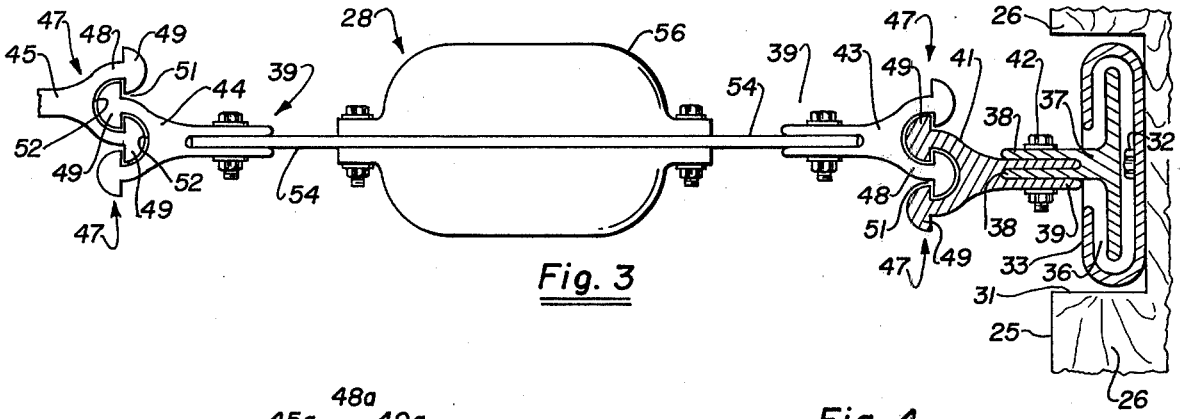
FIG. 3 is an enlarged, fragmentary, cross-sectional view taken substantially along the plane of line 3—3 in FIG. 1.

Referring now to FIGS. 1 and 3, the manner of attachment of floating boom 28 to the fender 24 and the construction of the end connector of the present invention can be described in detail. Mounted in a notch 31 in longitudinally extending fender beams 26 by means of a fastener 32 is a C-shaped, elongated, channel member 33. As will be seen in FIG. 1, channel member 33 extends over a substantial vertical height and is mounted to both the upper and lower longitudinally extending beams 26. Channel member 33 extends to a position substantially below the nominal water line 34, and is preferably formed with a closed lower end 36, which enables the support of a T-shaped extrusion 37 in the channel. T-shaped extrusion 37 preferably extends over the full height of channel 33. Extending outwardly from a side of T-shaped member 37 is a pair of legs 38 defining a slot therebetween for receipt of a correspondingly formed element.

As shown in FIG. 3, the corresponding element mounted in the slot between legs 38 is a first sides 39 of a connector 41 constructed in accordance with the present invention. The first side 39 of connector 41 is bolted by fastener 42 to T-shaped element 37. Connector 41, as best may be seen in FIG. 1, also preferably extends over the full height of channel 33.

As will become apparent, the first side 39 of the end connector of the present invention can also be coupled to a boom or other elements or members in a variety of manners. Since the floating barrier or boom is often of the type which is formed as a sheet-like partition or beltlike element, it is preferable that the legs of the first side 39 of the connector end be spaced apart by an amount sufficient to receive the partition or belt therebetween. In the present case, that amount is also sufficient to receive the similarly formed legs 38 of T-shaped element 37.

As will be seen, the end connector 41 and end connectors 43, 44 and 45 are all similarly formed. Each has generally vertically extending body with a first side 39 which is adapted for connection or mounting to a boom or T-shaped element and a second coupling side, generally designated 47, formed for releasable coupling to another similarly formed end connector. As will be understood, varying coupling applications could cause the body of the connector to take an orientation other than vertical.

The improved end connector of the present invention is formed to provide rapid, high strength coupling by forming the second side 47 as a yoke-like bifurcated side having a pair of spaced apart neck portions 48 each terminating in enlarged head portions 49. The neck portions and head portions define therebetween a throat 51 and an enlarged cavity 52 communicating therewith. As best may be seen in FIGS. 3 and 6, each of head portions 49 is preferably substantially similarly or identically formed, and cavity 52 defined by bifurcated neck portions 48 and head portions 49 has substantially the same shape as a head portion. Thus, the enlarged cavity is formed with a concaved surface mating with and formed for receipt of a similarly formed convex surface on head portion 49 of a second end connector, with the neck 48 of the second connector extending outwardly through throat 51. Additionally, in order to allow coupling and uncoupling of the connectors, at least one of the top and bottom ends of the coupling side 47 of the connectors should be open to permit vertical sliding of the couplers together into coupled relation.

Figure 5:
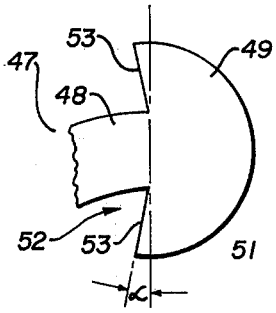
FIG. 5 is a further enlarged, fragmentary, top elevational view of the head portion and neck portion of the end connector of the present invention.

FIG. 5 illustrates the details of construction of the preferred form of the head portion 49 of the coupler of the present invention. Thus, it will be seen that head portion 49 includes inwardly facing surfaces 53 formed to engage oppositely facing surfaces on the head portion of a second connector. Inwardly facing surfaces 53 are inclined as indicated by angle in an inward direction proceeding from neck portion 48 outwardly on both sides of the head. This inward inclination of surfaces 53 causes the coupler head portion to tend to be drawn together and throat 51 to be narrowed upon application of an axial loading force on the end connectors when they are coupled together. Thus, a load on connectors 44 and 45 along the sheet-like partition or barrier 54 will cause the head portions 49 of coupler 44 to be drawn together and the head portions of coupler 45 to be drawn together, increasing the overall strength of the coupling with loading. Failure to provide inwardly inclining surfaces on head portions 49 would create an end connector in which loading would tend to cause separation of the head portions. This in turn would require the neck portions 48 to be capable of withstanding a substantial bending force in addition to the tension forces. It should also be noted that forming the head portion with surfaces 53 on both sides of the neck portion enables the head which is positioned in the cavity 52 to be subjected to a balanced load. As will also be apparent, the symmetry of the end connector enables coupling to a similarly formed end connector with either of head portions 49 disposed in cavity 52 and insures that the coupler is universal, that is, does not have a male or female side.

As best may be seen in FIG. 1, the universal end connector of the present invention normally has a body which is elongated in a vertical direction. Neck portions 48 and head portions 49 can be made to vertically extend to virtually any desired length to provide a vertically extending throat and vertically extending enlarged cavity having a height, as shown with connectors 43 and 44, which is equal to the height of belt 54, or a height, as shown with connector 41, equal to the vertical height of channel 33.

The construction of the connector of the present invention allows it to be readily formed from an extruded plastic such as nylon. The convex head portions 49 and mating concave cavity 52 defined by necks 48 can be extruded continuously and the connector merely cut to the desired length. The formation of the connector with continuously extending parallel side walls defining the head and neck, as well as the remainder of the connector body, is particularly useful in permitting vertical movement between coupled connectors. As is shown in FIG. 1, connector 41 can be installed on fender 24 to extend a substantial distance above and below water line 34. Floating boom section 28 can then be coupled to connector 41 by means of end connector 43. The uniform and parallel side walls of connectors 41 and 43 enables the floating boom to be reciprocated vertically with changes in elevation of water line 34, such as will occur under tide and wave action. Thus, the floats 56 on belt or partition 54 will carry the belt up and down with the water line with couplers 41 and 43 coupled together and the coupler 41 guiding vertical reciprocation of the coupler 43. It is highly advantageous, therefore, if one of the connectors in the coupling is substantially greater in length than the other and the other is free to reciprocate over the length of the longer of the two connectors.

It should be noted that buoyant or float elements 56 and short belt section 54 are preferably merely employed as additional floatation at the end of the deployable partition 28. The floating boom which actually surrounds the ship is not shown in the drawing and is not normally constructed in the same manner as is the segment 54 and floats 56. Instead, attached to coupler 45 is preferably a boom constructed as shown in my pending United States patent application Ser. No. 510,290, filed Sept. 30, 1974, and entitled "FLOATING BOOM HAVING ROTATABLE FLOAT ELEMENTS" or alternatively as is shown in my U.S. Pat. No. 3,807,178. Both of these booms employ a sheet-like partition or belt cantilevered and highly stable float elements mounted thereto. Another boom formed with a belt-like partition is shown in U.S. Pat. No. 3,882,682.

Having described the manner by which the deployable boom 28 can be secured to fender 24 by the coupler of the present invention so as to follow the tides, a further detailed description of the containment of any oil slick from passage beyond the fender can be set forth. Initially, it should be realized that the deployable boom 28 will extend out from the fender in one place and surround the ship and be attached to the fender at the opposite end of the ship. Any oil slick, therefore, cannot go outwardly of the boom.

In order to contain the oil from floating inwardly of fender 24 and subsequently under the pier or along fender 24, the fender has rigidly secured therein a plurality of panels 61 and 62, which can be advantageously formed of the same belt material used to form partition 54. Panels 61 and 62 form, with longitudinally extending beams 26, a barrier against passage of oil along the length of the fender. As may be seen in FIG. 2, the panels 61 and 62 are in general alignment with deployable boom 28 so as to effectively act as an extension of the boom. Panels 61 and 62 can be held or secured to longitudinally extending beams 26 by T-shaped elements 63 formed in the same manner as the T-shaped elements 37, which is positioned in channel 33. Such T-shaped elements can be bolted by fasteners 64 to beams 26 and can be provided with bolts or fasteners 66 which hold the belt-like panels 61 and 62 to the T-shaped element. The T-shaped elements 63 act as a frame extending all the way around panels 61 and 62 to rigidly secure the panels to the fender.

With the oil effectively contained by the deployable boom 28 and the permanently affixed panels so as to contain the same along the length of the fender, there remains the problem of containment of any oil slick from entry under pier 21. This containment is accomplished by longitudinally extending floating barrier 29. Barrier 29, best seen in FIG. 2, includes a sheet-like partition 67 similar to the construction of the partition 54 employed for the deployable boom and in the panels 61 and 62. Periodically affixed along the length of partition 67 are float elements 68. Float elements 68 can have a buoyancy selected to cause the partition to float at a height above the water about equal to that of the deployable boom 28. Since float elements 68 are not symmetrically arranged with respect to partition or belt 67 and since it is further desired to hold the partition in a guided predetermined position, a cable or line 69 having a weight 71 thereon is suspended from a bracket 72 affixed to fender 24. Line 69 passes through guide means (not shown) mounted to at least one of the partition or belt 67 and float 68. Preferably, guide means in the form of a pair of vertically spaced eyelets or channels bolted to belt 67 can be provided. The guide means insures a vertical orientation of the partition and bracket 72 and weight 71 insure positioning of floating barrier 29 at a relatively fixed location behind fender 24. As will be appreciated, weighted lines 69 can be located periodically along the longitudinal length of the fender, as required, in order to insure proper positioning of barrier 29. As will also be appreciated, most piers are located in harbors or the like where the wave action is not excessive, and the weighted line can be readily employed to effectively relatively fixedly locate barrier 29. It is possible to position barrier 29 by means other than a weighted line.

Figure 4:
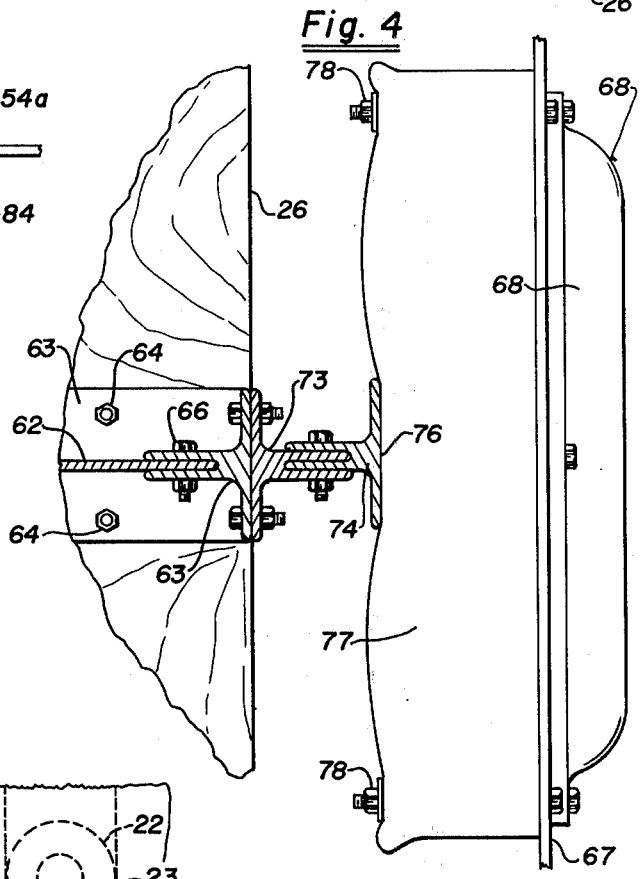
FIG. 4 is an enlarged, fragmentary, cross-sectional view taken substantially along the plane of line 4—4 in FIG. 1.

In order to provide a seal between longitudinally extending barrier 29 and transversely extending boom 28 and panels 61 and 62, a T-shaped extrusion 73 is bolted in a back-to-back relation with similarly formed extrusion 63 on the rear side of panels 61 and 62. T-shaped extrusion 73 extends from the top of the fender to a position substantially below the water line in the same fashion as does elongated connector 41. A second T-shaped extrusion 74 is then bolted to extrusion 73, as best may be seen in FIG. 4. This second extrusion provides a vertically extending flat surface 76 against which a resilient wiper pad 77 bears. Wiper pad 77 is bolted by fasteners 78 to the longitudinally extending barrier belt 67. As thus constructed, barrier 29 can rise and fall with the tides while the resilient wiper pad 77 maintains a moving seal with the vertically extending surface 76, regardless of the water level.

Both barriers 28 and 29, therefore, rise and fall along the vertically extending connector 41 on one side and T-shaped extrusion 74 on the other side so as to contain any oil or other floating pollutants within these barriers and prevent their escape longitudinally of fender 24 or inwardly under pier 21.

It should also be noted that it is preferable to slide T-shaped element 37 and coupler 41 out of channel 33 during docking and undocking of vessels so that these elements do not stick out of notch 31 beyond surface 25 and get inadvertently crushed during the docking procedure. Once the vessel is moored element 37 and coupler 41 can be reinstalled in channel 33 and boom 28 coupled thereto by connector 43.

Figure 6:
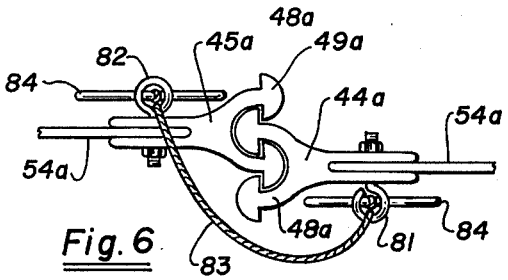
FIG. 6 is a top plan view of the end connector as shown in FIG. 3 with a locking means illustrated.
Figure 7:
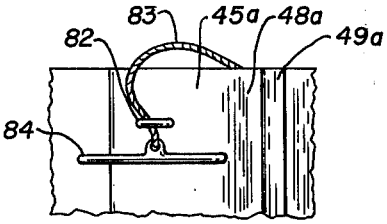
FIG. 7 is a fragmentary, side elevational view of the end connector of FIG. 6.

While relative movement between end connectors 43 and 41 is desirable to accommodate variances in the tides, there are situations in which extreme vertical movement between the end connectors of the present invention are not desirable. One manner of restricting vertical movement would be simply to pass a pin through coupled parts, but a preferred and advantageous method of limiting the vertical reciprocation between end connectors of the present invention is shown in FIGS. 6 and 7. As there illustrated, coupler **44*a* is secured to belt 54*a* by means of a plurality of fasteners. The uppermost of these fasteners can advantageously be formed with a means providing a restricted passageway, such as an eyelet 81, while a similar passageway or eyelet 82 is provided as the uppermost fastener for coupler 45*a* to secure it to the end of another belt-like section 54*a*. In order to provide a means for quickly securing the end connectors for limited vertical movement, a flexible wire or cable 83 having a toggle-like element 84 secured to each end thereof may be provided. As best may be seen in FIG. 7, toggle element 84 is secured to cable 83 about the mid-point thereof. It is possible to pass the entire toggle element 84 down through the eyelet by rotating the toggle until the long legs are vertical and oriented to drop through the eyelet. With the wire 83** secured at the mid-point of the toggle element, once passed through the eyelet gravity will cause the toggle element to assume a substantially horizontal orientation preventing the same from being withdrawn from the eyelet. This process allows the toggle elements to be dropped through each of the eyelets, thus connecting the flexible wire across the connectors and limiting the amount of vertical reciprocation possible. In many applications such a means for limiting the vertical reciprocation between the end connectors is not necessary, but in booms where the vertical height of the end connectors is not great or the wave conditions can be severe, such a limiting means is advantageous.

What is claimed is:

1. In a universal end connector for releasably coupling together aligned ends of a floating boom or the like, said end connector including a connector body formed with a first side adapted for mounting to an end of a floating boom and a second side formed for releasable coupling to another end connector, the improvement comprising:

said second side being formed as a yoke-like bifurcated side having a pair of spaced apart neck portions each terminating in enlarged head portions, said neck portions and said head portions defining therebetween a throat and an enlarged cavity, said throat and cavity being formed for mating receipt of a head portion and a neck portion on a similarly formed end connector with the head portion of said similarly formed end connector positioned in said cavity and the neck portion thereof extending outwardly through said throat, said throat and said cavity being open at at least one of a top and a bottom end thereof to permit positioning of said end connector in coupled relation to said similarly formed end connector, said head portions each include inwardly facing surfaces formed to engage oppositely facing surfaces on the head portion of said similarly formed end connector, and said inwardly facing surfaces are inclined to cause said head portions to be pulled together to tend narrow said throat when coupled to said similarly formed end connector and a longitudinal force is applied to the connectors.

2. The universal end connector as defined in claim 1 wherein, said inwardly facing surfaces extend from said neck portion toward said throat on one side of said head portions and from said neck portions in an opposite direction on the other side of said head portions, and said inwardly facing surfaces are inclined in an inward direction proceeding outwardly from said neck portions on both sides of said head portions.

3. The universal end connector as defined in claim 1 wherein, said body is elongated in the vertical direction and said neck portions and said head portions are vertically extending to provide a vertically extending throat and a vertically extending cavity.

4. The universal end connector as defined in claim 1 wherein, said head portions are substantially identical in horizontal cross-section and are formed with convex arcuate outwardly facing surfaces and said cavity is formed with a concave outwardly facing surface.

5. The universal end connector as defined in claim 1 wherein, said first side is formed with a pair of side-by-side legs defining a slot therebetween for receipt of a sheet-like partition forming part of a floating boom therein.

6. The universal end connector as defined in claim 1 wherein, said end connector is formed from an extruded plastic.

7. In a coupling for releasably coupling together aligned ends of a floating boom or the like, said coupling including a pair of end connectors each adapted for mounting to an end of a floating boom and each having a coupling side formed for interengagement and coupling with the coupling side of the other end connector, the improvement comprising:

each said coupling side of said end connectors being formed with substantially the same configuration and each including yoke-like bifurcated coupling side having a pair of spaced apart necks terminating in enlarged heads projecting outwardly from each side of said necks, said necks and heads defining a throat and an enlarged cavity communicating therewith, and at least one of said heads of a first of said end connectors being mounted in said cavity in a second of said end connectors with a neck of the first end connector extending outwardly through said throat of the second end connector, and at least one of the heads of the second end connector being mounted in said cavity of the first end connector with the neck of the second end connector extending outwardly through the throat of the first end connector.

8. A coupling as defined in claim 7 wherein, said head portions are formed to be outwardly extending on both sides of said neck portion and are formed with inwardly facing surfaces on both sides of each of said neck portions for balanced loading of at least one of said neck portions.

9. A coupling as defined in claim 8 wherein, said inwardly facing surfaces are inclined inwardly proceeding from said neck portions to the outermost edges of said surfaces.

10. A coupling as defined in claim 7 wherein, said coupling side of each of said end connectors is formed for relative vertical sliding movement of a head portion of said end connectors in the cavity of the remainder of said end connectors, and means for limiting relative vertical movement of said end connectors.

11. A coupling as defined in claim 10 wherein, each connector end is formed with means providing a restricted passageway, and means for limiting movement of said connector ends mounted in each said restricted passageway, said means for limiting movement includes a pair of toggle elements formed for orientation in a direction allowing passage through said restricted passageway and formed for gravity biasing to an orientation preventing passage through said passageway, and flexible tendon means connecting said toggle elements.

12. A coupling as defined in claim 7 wherein, one of said connectors has a vertical height substantially in excess of the vertical height of the remainder of said end connectors, and said end connectors are formed for free sliding relative reciprocation in a vertical direction while in coupled relation.

* * * * *

Disclaimer and Dedication 4,003,206.—*Neeld D. Tanksley*, Antioch, Calif. UNIVERSAL END CONNECTOR FOR FLOATING BOOM. Patent dated Jan. 18, 1977. Disclaimer and dedication filed Mar. 27, 1979, by the assignee, *Acqua Control, Inc.*

Hereby disclaims and dedicates all claims of said patent.

[*Official Gazette August 28, 1979.*]